US011279581B2

(12) United States Patent
Akagawa

(10) Patent No.: US 11,279,581 B2
(45) Date of Patent: Mar. 22, 2022

(54) SHEET CONVEYING DEVICE, IMAGE FORMING APPARATUS INCLUDING THE SAME, AND SHEET CONVEYING METHOD

(71) Applicant: SHARP KABUSHIKI KAISHA, Sakai (JP)

(72) Inventor: Yuhhi Akagawa, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 278 days.

(21) Appl. No.: 16/422,561

(22) Filed: May 24, 2019

(65) Prior Publication Data

US 2019/0367304 A1 Dec. 5, 2019

(30) Foreign Application Priority Data

Jun. 1, 2018 (JP) ..... JP2018-106040

(51) Int. Cl.
*B65H 9/00* (2006.01)
*B65H 5/06* (2006.01)
*B65H 9/14* (2006.01)

(52) U.S. Cl.
CPC ..... *B65H 9/006* (2013.01); *B65H 5/062* (2013.01); *B65H 9/14* (2013.01); *B65H 2403/50* (2013.01); *B65H 2403/72* (2013.01); *B65H 2403/732* (2013.01); *B65H 2404/1431* (2013.01); *B65H 2513/10* (2013.01); *B65H 2801/03* (2013.01); *G03G 2215/00679* (2013.01); *G03G 2221/1657* (2013.01)

(58) Field of Classification Search
CPC ..... B65H 9/006; B65H 2404/1431; B65H 2403/732; B65H 2403/72; B65H 2403/50
See application file for complete search history.

(56) References Cited

U.S. PATENT DOCUMENTS 6,390,467 B1 * 5/2002 Fukube ..... B65H 9/006 271/256
8,613,445 B2 * 12/2013 Nishii ..... B65H 9/006 271/291
2013/0119598 A1 * 5/2013 Kuo ..... B65H 9/006 271/10.11

FOREIGN PATENT DOCUMENTS

JP H07-285688 A 10/1995
JP 2017-077962 A 4/2017

* cited by examiner

*Primary Examiner* — Jeremy R Severson
(74) *Attorney, Agent, or Firm* — ScienBiziP, P.C.

(57) ABSTRACT

A sheet conveyance device, an image forming apparatus, and a sheet conveying method that convey a sheet in a predetermined sheet conveyance direction make a surface moving speed of a driven roller higher than a surface moving speed of a drive roller when a rotational driving force from the drive roller is transmitted to the driven roller, and by a one-way clutch that is provided at any place in a drive transmission path from the drive roller to the driven roller, restrict relative rotation of the driven roller in a first rotation direction, which is the sheet conveyance direction, with respect to the drive roller while allowing relative rotation of the driven roller in a second rotation direction, which is a direction opposite to the first rotation direction, with respect to the drive roller.

6 Claims, 9 Drawing Sheets

SHEET CONVEYING DEVICE, IMAGE FORMING APPARATUS INCLUDING THE SAME, AND SHEET CONVEYING METHOD

BACKGROUND

1. Field

The present disclosure relates to a sheet conveying device, an image forming apparatus including the same, such as a copier, a multifunction peripheral, a printer, or a facsimile machine, and a sheet conveying method.

2. Description of the Related Art

Normally, an image forming apparatus includes a sheet conveying device that conveys a sheet by a pair of conveyance rollers. Such an image forming apparatus is generally configured so that, in a state where rotation of the pair of conveyance rollers (generally called resist rollers) is stopped, after a leading edge of a conveyed sheet is brought into contact with the pair of conveyance rollers to temporarily stop the sheet, the pair of conveyance rollers rotates to convey the sheet. Thereby, a conveyance timing of the sheet with respect to an image that is formed on an image bearing member or an intermediate transfer member is adjusted, so that it is possible to suppress oblique feeding (skew) of the sheet.

Such an image forming apparatus has a configuration in which one of the pair of conveyance rollers is a drive roller and the other is a driven roller, so that the driven roller is driven to rotate by following rotational driving of the drive roller. In this case, while the drive roller is stopped, the driven roller contacts the stopped drive roller but is in a state where rotation is allowed to some extent. Thus, the driven roller slightly rotates in some cases due to an impact when the sheet is brought into contact with the pair of conveyance rollers. Then, when the leading edge of the sheet is brought into contact with the pair of conveyance rollers, the leading edge of the sheet slightly protrudes from a nip portion of the pair of conveyance rollers, resulting that the sheet is deviated from the image formed on the image bearing member or the intermediate transfer member or the sheet is obliquely fed.

Thus, conventionally, the pair of conveyance rollers is connected by a drive transmission mechanism that transmits a rotational driving force from the drive roller to the driven roller, and while the drive roller is stopped, the drive transmission mechanism applies a brake to the driven roller, so that the driven roller is also stopped reliably (for example, refer to Japanese Unexamined Patent Application Publication No. 2017-77962). Note that, an example of the drive transmission mechanism includes a drive transmission mechanism including a gear alone, a gear and a belt, a pulley and a belt, or the like.

However, due to defective accuracy in variation or the like of a component constituting the drive transmission mechanism, the drive roller and the driven roller are not matched or are not substantially matched in rotation (a surface moving speed) in some cases. In this case, it is difficult to convey a sheet at a stable speed due to rotational unevenness or the like, resulting that an image that is formed on the sheet is affected. For example, a periodic horizontal stripe which is generally called banding may occur in the image formed on the sheet.

In this respect, Japanese Unexamined Patent Application Publication No. 7-285688 discloses a mechanism in which a feed roller shaft is provided with a feed roller via a one-way clutch and rotation of the feed roller shaft is transmitted via the one-way clutch to drive the feed roller. In such a configuration, it is possible to suppress occurrence of a phenomenon in which the feed roller is reversed due to strength of a loop of paper and thereby the paper moves back when the paper is aligned between a paper separating device and a resist roller device.

In the drive transmission mechanism described in Japanese Unexamined Patent Application Publication No. 7-285688, however, the one-way clutch is merely provided to suppress the occurrence of the phenomenon in which the feed roller is reversed and the paper moves back, and inconvenience that, in a case where a drive roller and a driven roller are not matched or are not substantially matched in rotation due to defective accuracy in variation or the like of a component constituting the drive transmission mechanism, a sheet is difficult to be conveyed at a stable speed because of difficulty such as rotational unevenness is not overcome.

The disclosure provides a sheet conveying device, an image forming apparatus, and a sheet conveying method that convey a sheet at a stable speed and are able to avoid rotation of a driven roller due to an impact when the sheet is brought into contact with a pair of conveyance rollers.

In order to cope with the aforementioned problem, a sheet conveying device, an image forming apparatus, and a sheet conveying method according to the following disclosure are provided.

SUMMARY (1) Sheet Conveying Device

A sheet conveying device according to the disclosure is a sheet conveying device that conveys a sheet in a predetermined sheet conveyance direction by a pair of conveyance rollers constituted by a drive roller and a driven roller, and includes: a drive transmission mechanism that is configured so that, when a rotational driving force from the drive roller is transmitted to the driven roller, a surface moving speed of the driven roller is higher than a surface moving speed of the drive roller; and a one-way clutch that is provided at any place in a drive transmission path from the drive roller to the driven roller in the drive transmission mechanism, in which the one-way clutch restricts relative rotation of the driven roller in a first rotation direction, which is the sheet conveyance direction, with respect to the drive roller while allowing relative rotation of the driven roller in a second rotation direction, which is a direction opposite to the first rotation direction, with respect to the drive roller.

(2) Image Forming Apparatus

An image forming apparatus according to the disclosure includes the sheet conveying device according to the disclosure, in which in a state where rotation of the pair of conveyance rollers is stopped, after a leading edge of the conveyed sheet is brought into contact with the pair of conveyance rollers to temporarily stop the sheet, the pair of conveyance rollers rotates to convey the sheet.

(3) Sheet Conveying Method

A sheet conveying method according to the disclosure is a sheet conveying method that conveys a sheet in a predetermined sheet conveyance direction by a pair of conveyance rollers constituted by a drive roller and a driven roller, and includes: making a surface moving speed of the driven roller higher than a surface moving speed of the drive roller when a rotational driving force from the drive roller is transmitted to the driven roller; and by a one-way clutch that is provided at any place in a drive transmission path from the drive roller to the driven roller, restricting relative rotation of the driven roller in a first rotation direction, which is the sheet conveyance direction, with respect to the drive roller while allowing relative rotation of the driven roller in a second rotation direction, which is a direction opposite to the first rotation direction, with respect to the drive roller.

DESCRIPTION OF THE EMBODIMENTS

Hereinafter, embodiments according the disclosure will be described with reference to drawings. In the following description, the same reference signs are assigned to the same components. The components also have the same names and functions. Accordingly, detailed description thereof will not be repeated.

<Configuration of Image Forming Apparatus>

Figure 1:
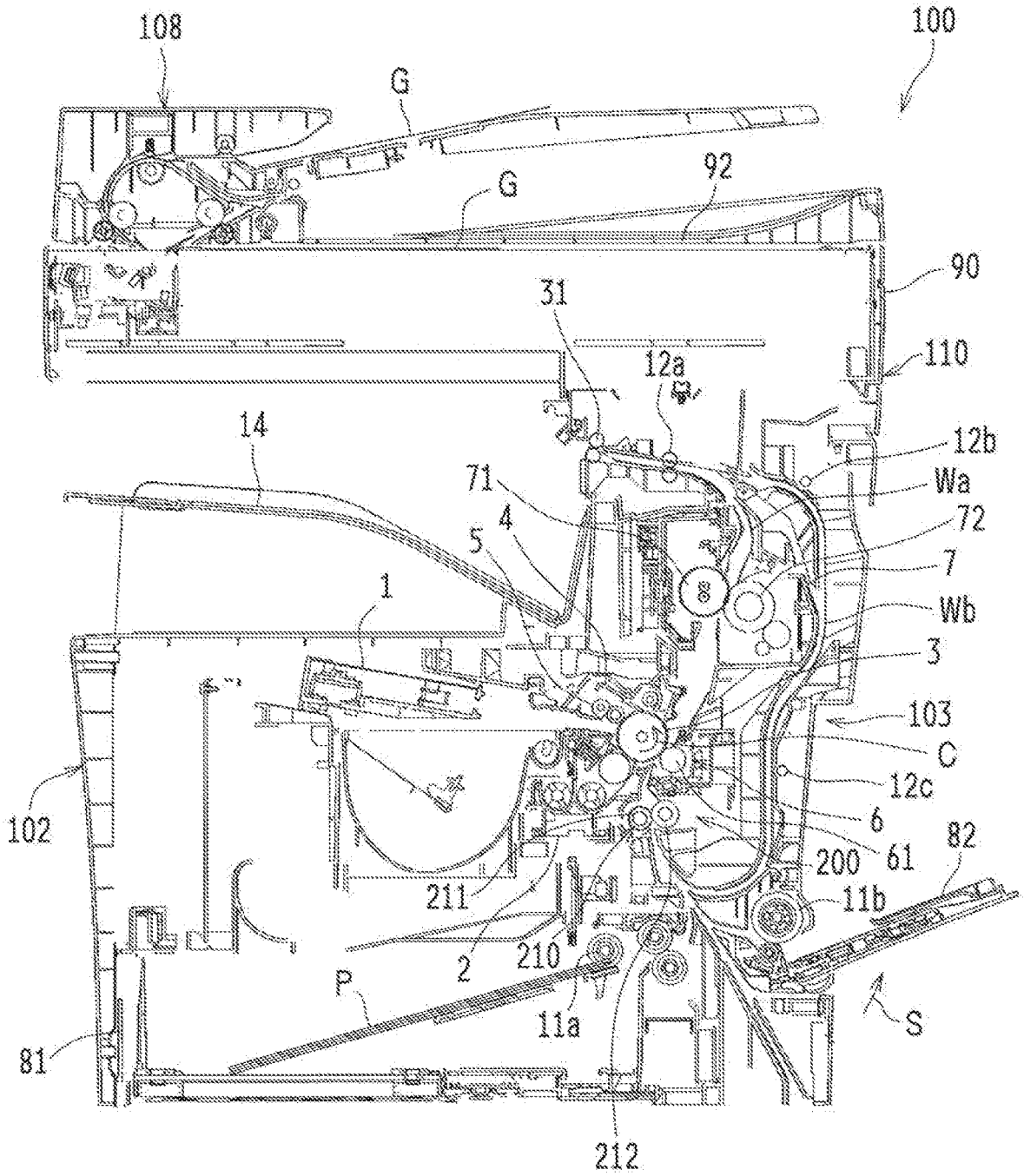
FIG. 1 is a schematic sectional view of an image forming apparatus including a sheet conveying device according to the present embodiments, which is viewed from a front side.

FIG. 1 is a schematic sectional view of an image forming apparatus 100 including a sheet conveying device 200 according to the present embodiments, which is viewed from a front side. The image forming apparatus 100 illustrated in FIG. 1 is a monochromatic image forming apparatus that forms a monochromatic image on a sheet P such as recording paper in accordance with image data that is read by an original reading device 108 or image data that is transmitted from outside. Note that, the image forming apparatus 100 may be, for example, a multicolor image forming apparatus (in particular, a multicolor image forming apparatus of an intermediate transfer system) that is able to form a multicolored image.

The image forming apparatus 100 includes the original reading device 108 and an image forming apparatus main body 110, and an image forming unit 102 and a sheet conveying system 103 are provided in the image forming apparatus main body 110.

The image forming unit 102 includes an exposure unit 1, a development unit 2, a photosensitive drum 3 that serves as an electrostatic latent image carrier, a cleaning unit 4, a charging unit 5, a transfer unit 6, and a fixing unit 7. Moreover, the sheet conveying system 103 includes a sheet feeding tray 81, a manual sheet feeding tray 82, and a sheet discharge tray 14.

An original platen 92 which is made from transparent glass and on which an original G is placed is provided above the image forming apparatus main body 110, and an optical unit 90 by which the original G is read is provided below the original paten 92. Furthermore, the original reading device 108 is provided on an upper side of the original platen 92. An image of the original G that is read by the original reading device 108 is transmitted to the image forming apparatus main body 110 as image data and an image that is formed on the basis of the image data is recorded on the sheet P in the image forming apparatus main body 110.

In the image forming apparatus main body 110, a sheet conveyance path Wa by which the sheet P which is fed from the sheet feeding tray 81 or the manual sheet feeding tray 82 is guided to the sheet discharge tray 14 through a transfer roller 61 and the fixing unit 7 in the transfer unit 6 is provided. In a vicinity of the sheet conveyance path Wa, pickup rollers 11*a* and 11*b*, a pair of conveyance rollers 210 (resist rollers), the transfer roller 61, a heat roller 71 and a pressure roller 72 in the fixing unit 7, a pair of sheet rollers 12*a*, and a pair of discharge rollers 31 are disposed. The pair of conveyance rollers 210 is rotationally driven by a rotational driving unit (drive motor) whose illustration is omitted. The rotational driving unit is configured to be restricted to rotate (not to rotate) while the drive is stopped.

The image forming apparatus 100 includes a sheet accommodation device (specifically, the sheet feeding tray 81 or the manual sheet feeding tray 82) that accommodates a sheet, and the sheet conveying device 200 that conveys the sheet P that is fed from the sheet accommodation device. When the image forming apparatus 100 performs an operation of image formation, the sheet P which is accommodated in the sheet accommodation device is supplied from the sheet accommodation device to the image forming apparatus main body 110 one by one by a sheet supplying member (specifically, the pickup rollers 11*a* and 11*b*) and is subjected to image formation in the image forming apparatus main body 110.

When the image forming apparatus 100 performs image formation, the sheet P is supplied from the sheet feeding tray 81 or the manual sheet feeding tray 82 and is conveyed to the pair of conveyance rollers 210. Next, the sheet P is conveyed by the transfer roller 61 at a timing when the sheet P is aligned with a toner image on the photosensitive drum 3 that rotates in a rotation direction C, and the toner image is transferred onto the sheet P. After that, the sheet P passes through the heat roller 71 and the pressure roller 72 in the fixing unit 7 so that unfixed toner on the sheet P is fused with heat and fixed, and the sheet P is discharged on the sheet discharge tray 14 through the sheet roller 12*a* and the discharge rollers 31.

When image formation is performed not only on a front surface of the sheet P but also on a back surface thereof, the sheet P is conveyed in an inverse direction from the discharge rollers 31 toward a sheet reverse conveyance path Wb and guided to the pair of conveyance rollers 210 again with the front surface and the back surface of the sheet P reversed through reverse conveyance rollers 12*b* and 12*c*, the toner image is formed on the back surface of the sheet P and fixed similarly to the front surface of the sheet P, and then the sheet P is discharged to the sheet discharge tray 14.

[Sheet Conveying Device]

The sheet conveying device 200 conveys the sheet P in a predetermined sheet conveyance direction S by the pair of conveyance rollers 210 that is constituted by a drive roller 211 and a driven roller 212.

In the present embodiment, the pair of the conveyance rollers 210 serves as resist rollers. That is, the image forming apparatus 100 is configured so that, in a state where rotation of the pair of conveyance rollers 210 is stopped, after a leading edge of a conveyed sheet P is brought into contact with the pair of conveyance rollers 210 to temporarily stop the sheet P, the pair of conveyance rollers 210 rotates to convey the sheet P.

Figure 2:
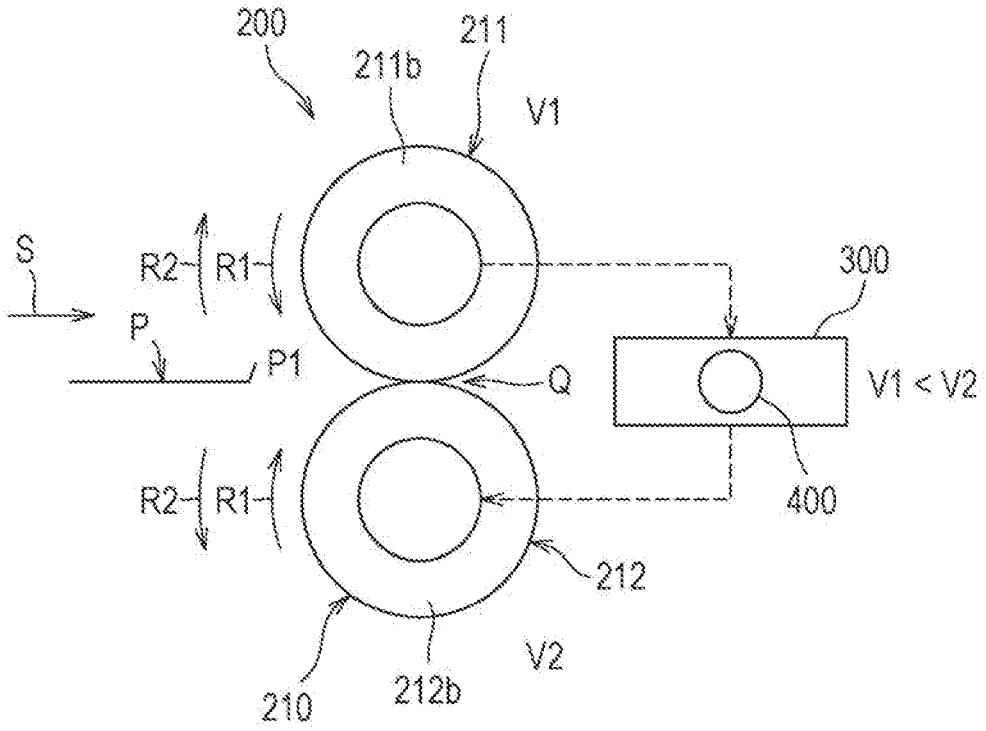
FIG. 2 is a schematic block diagram of a drive system of a drive transmission mechanism and a one-way clutch in the sheet conveying device.

FIG. 2 is a schematic block diagram of a drive system of a drive transmission mechanism 300 and a one-way clutch 400 in the sheet conveying device 200.

The sheet conveying device 200 includes the drive transmission mechanism 300 and the one-way clutch 400.

The drive transmission mechanism 300 is configured so that, when a rotational driving force from the drive roller 211 is transmitted to the driven roller 212, a surface moving speed V2 (peripheral speed) of the driven roller 212 is higher than a surface moving speed V1 (peripheral speed) of the drive roller 211. The one-way clutch 400 is provided at any place in a drive transmission path from the drive roller 211 to the driven roller 212 in the drive transmission mechanism 300.

The one-way clutch 400 allows relative rotation of the driven roller 212 in a second rotation direction R2 with respect to the drive roller 211. Here, the second rotation direction R2 is a direction opposite to a first rotation direction R1 that is the sheet conveyance direction S. Moreover, the one-way clutch 400 restricts (forbids) relative rotation of the driven roller 212 in the first rotation direction R1 with respect to the drive roller 211.

According to the present embodiment, when the sheet P is conveyed, the drive transmission mechanism 300 transmits a rotational driving force from the drive roller 211 to the driven roller 212 so that the surface moving speed V2 of the driven roller 212 is higher than the surface moving speed V1 of the drive roller 211. At this time, the one-way clutch 400 which is provided at any place in the drive transmission path from the drive roller 211 to the driven roller 212 in the drive transmission mechanism 300 allows relative rotation of the driven roller 212 in the second rotation direction R2 with respect to the drive roller 211. This makes it possible to idly rotate the one-way clutch 400 when the sheet P is conveyed, so that defective accuracy in variation or the like of a component constituting the drive transmission mechanism 300 is able to be avoided. Then, the drive roller 211 and the driven roller 212 are able to be matched or substantially matched in rotation, so that inconvenience due to rotational unevenness or the like is able to be avoided. Accordingly, the sheet P is able to be conveyed at a stable speed, and occurrence of banding is able to be effectively suppressed after all. On the other hand, the one-way clutch 400 restricts the relative rotation of the driven roller 212 in the first rotation direction R1 with respect to the drive roller 211. Thereby, while the drive roller 211 is stopped, the relative rotation of the driven roller 212 in the first rotation direction R1 with respect to the drive roller 211 is being restricted. Thus, even when there is an impact when the sheet P is brought into contact with the pair of conveyance rollers 210, rotation of the driven roller 212 is able to be avoided. Thereby, when the leading edge P1 of the sheet P is brought into contact with the pair of conveyance rollers 210, it is possible to avoid protrusion of the leading edge P1 of the sheet P from a nip portion Q of the pair of conveyance rollers 210 and thus deviation of the sheet P from the image formed on the image bearing member or the intermediate transfer member (photosensitive drum 3 in the example) and oblique feeding of the sheet P are able to be effectively suppressed.

Next, a drive transmission operation of the rotational driving force from the drive roller 211 to the driven roller 212 by the one-way clutch 400 will be described.

Figure 3A:
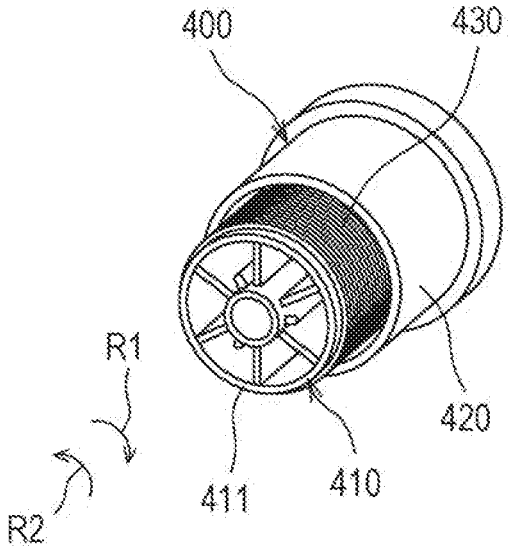
FIG. 3A is a perspective view schematically illustrating an aspect of the one-way clutch.
Figure 3B:
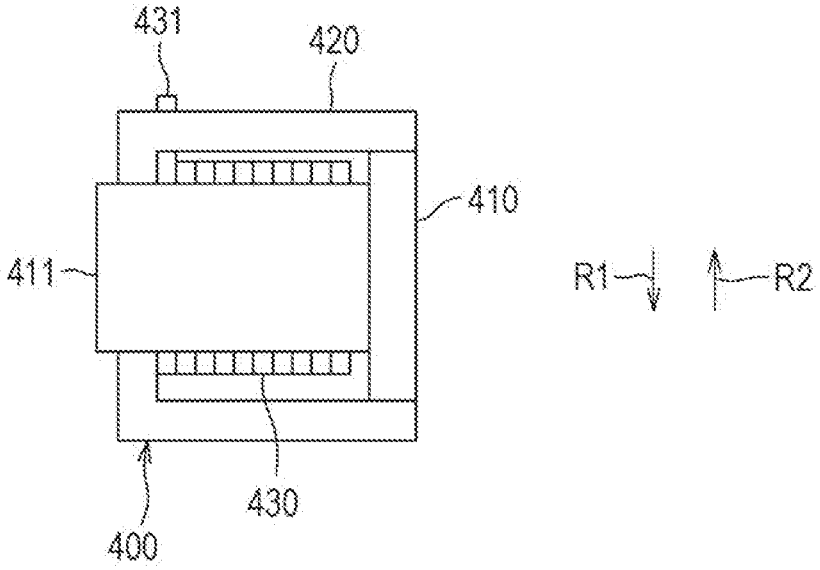
FIG. 3B is a vertical sectional view schematically illustrating an aspect of the one-way clutch.

FIGS. 3A and 3B are respectively a perspective view and a vertical sectional view each schematically illustrating an aspect of the one-way clutch 400.

In the present embodiment, the one-way clutch 400 includes a first member (specifically, an inner race 410) and a second member (specifically, an outer race 420) that are provided in such a manner that relative rotation of the first member with respect to the second member is freely allowed in one direction and is not allowed in the other direction.

In this example, the one-way clutch 400 includes a coil spring 430 and has a structure in which the coil spring 430 is inserted into an inner race shaft 411 and one end 431 of the coil spring 430 is fixed to the outer race 420.

The one-way clutch 400 that has such a structure allows relative rotation of the driven roller 212 in the second rotation direction R2 with respect to the drive roller 211. In a state where the drive roller 211 and the driven roller 212 rotate in the first rotation direction R1, when the driven roller 212 relatively rotates in the second rotation direction R2 with respect to the drive roller 211, one of the inner race 410 and the outer race 420, which is on a drive side, rotates faster than the other one which is on a driven side rotates. In this example, the coil spring 430 is twisted in a direction to be loosened with respect to the inner race shaft 411. Then, an inner diameter of the coil spring 430 is expanded and a frictional force between a contact surface of the inner race shaft 411 and a contact surface of the coil spring 430 is reduced or disappears. This makes it possible to allow the relative rotation of the driven roller 212 in the second rotation direction R2 with respect to the drive roller 211.

On the other hand, the one-way clutch 400 restricts the relative rotation of the driven roller 212 in the first rotation direction R1 with respect to the drive roller 211. Thus, in a state where the drive roller 211 and the driven roller 212 are stopped, the driven roller 212 does not rotate in the first rotation direction R1 with respect to the drive roller 211. In the example, in a case where the driven roller 212 is caused to rotate in the first rotation direction R1 relative to the drive roller 211, the coil spring 430 is twisted in a direction to be tightened with respect to the inner race shaft 411. Then, the inner diameter of the coil spring 430 is contracted and the frictional force between the contact surface of the inner race shaft 411 and the contact surface of the coil spring 430 is increased. This makes it possible to restrict the relative rotation of the driven roller 212 in the first rotation direction R1 with respect to the drive roller 211.

Next, specific examples of a case where the inner race is connected to the driven side and the outer race is connected to the drive side and a case where the inner race is connected to the drive side and the outer race is connected to the driven side will be described in order.

First Embodiment

[When Inner Race is Connected to Driven Side and Outer Race is Connected to Drive Side]

First, an example in which the one-way clutch 400 has the inner race 410 connected to the driven side and the outer race 420 connected to the drive side will be described below with reference to FIGS. 4A to 5B.

(When Sheet is Conveyed by a Pair of Conveyance Rollers)

Figure 4A:
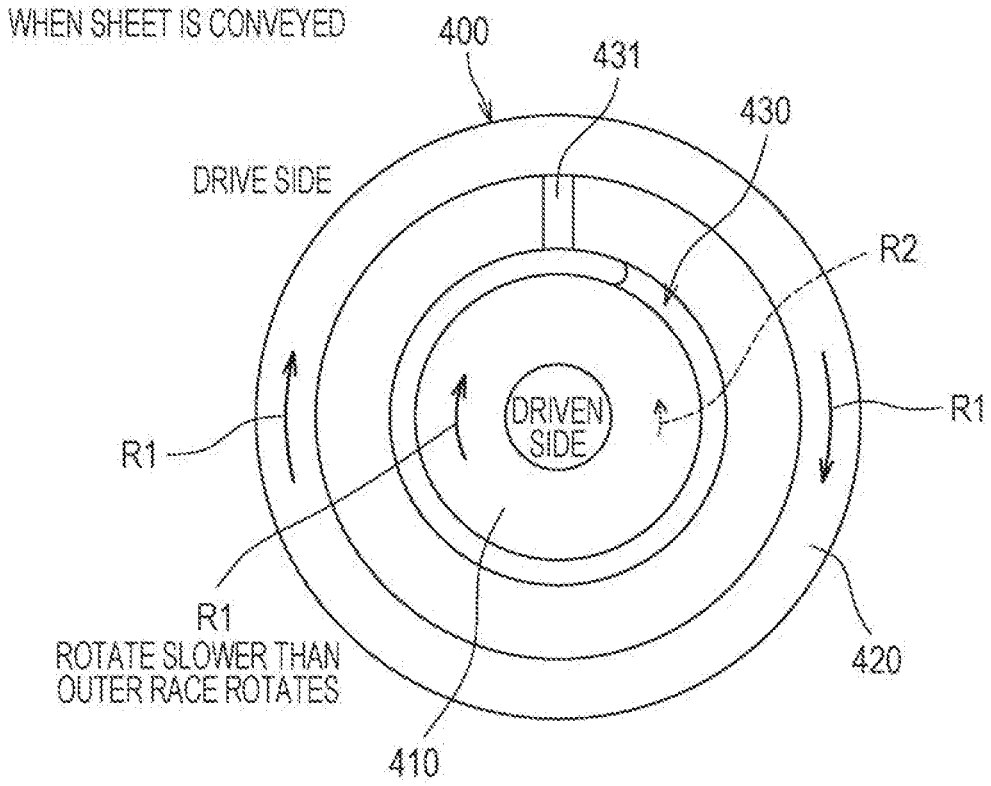
FIG. 4A is a schematic sectional view schematically illustrating an operation state of an example of the one-way clutch in a case where a sheet is conveyed by a pair of conveyance rollers when the first rotation direction is clockwise.
Figure 5A:
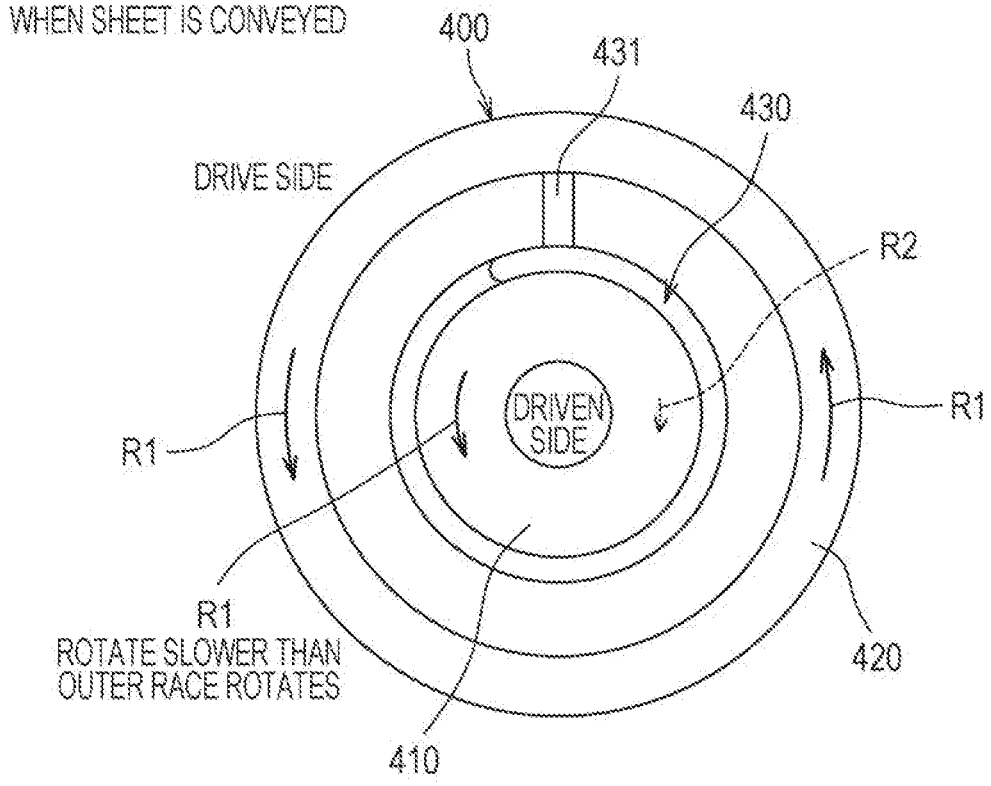
FIG. 5A is a schematic sectional view schematically illustrating an operation state of an example of the one-way clutch in a case where a sheet is conveyed by the pair of conveyance rollers when the first rotation direction is counterclockwise.

FIG. 4A is a schematic sectional view schematically illustrating an operation state of an example of the one-way clutch 400 in a case where a sheet is conveyed by the pair of conveyance rollers 210 when the first rotation direction R1 is clockwise. FIG. 5A is a schematic sectional view schematically illustrating an operation state of an example of the one-way clutch 400 in a case where a sheet is conveyed by the pair of conveyance rollers 210 when the first rotation direction R1 is counterclockwise.

The drive transmission mechanism 300 is configured so that the surface moving speed V2 of the driven roller 212 is higher than the surface moving speed V1 of the drive roller 211, but as illustrated in FIGS. 4A and 5A, since the inner race 410 rotates slower than the outer race 420 rotates, the one-way clutch 400 is brought into an idling state. Then, the driven roller 212 is driven to rotate in the first rotation direction R1 when a surface of a roller unit 212*a* contacts a surface of a roller unit 211*a* of the drive roller 211 which is rotationally driven in the first rotation direction R1. Accordingly, a rotational driving force is transmitted from the drive roller 211 to the driven roller 212 not via the drive transmission mechanism 300 but via the roller units 211*a* and 212*a*. That is, the surface moving speed V2 of the driven roller 212 becomes higher than the surface moving speed V1 of the drive roller 211 by the drive transmission mechanism 300, but the idling of the one-way clutch 400 makes the surface moving speed V1 of the drive roller 211 and the surface moving speed V2 of the driven roller 212 the same or substantially the same. At this time, in the one-way clutch 400, both the outer race 420 and the inner race 410 rotate in the same first rotation direction R1. However, since the surface moving speed of the drive roller 211 and the surface moving speed of the driven roller 212 become the same or substantially the same, the inner race 410 on the driven side relatively rotates in the second rotation direction R2 accordingly with respect to the outer race 420 on the drive side. That is, a rotation speed of the inner race 410 in the first rotation direction R1 becomes lower than a rotation speed of the outer race 420 in the first rotation direction R1.

(When a Pair of Conveyance Rollers is Stopped)

Figure 4B:
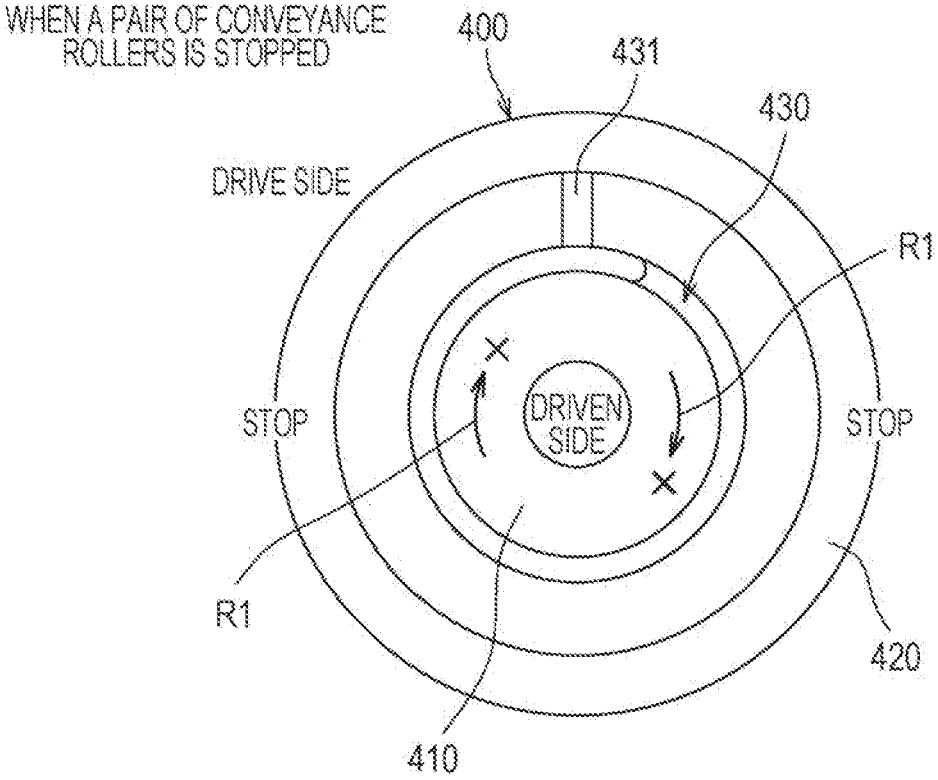
FIG. 4B is a schematic sectional view schematically illustrating an operation state of the one-way clutch illustrated in FIG. 4A when the pair of conveyance rollers is stopped.
Figure 5B:
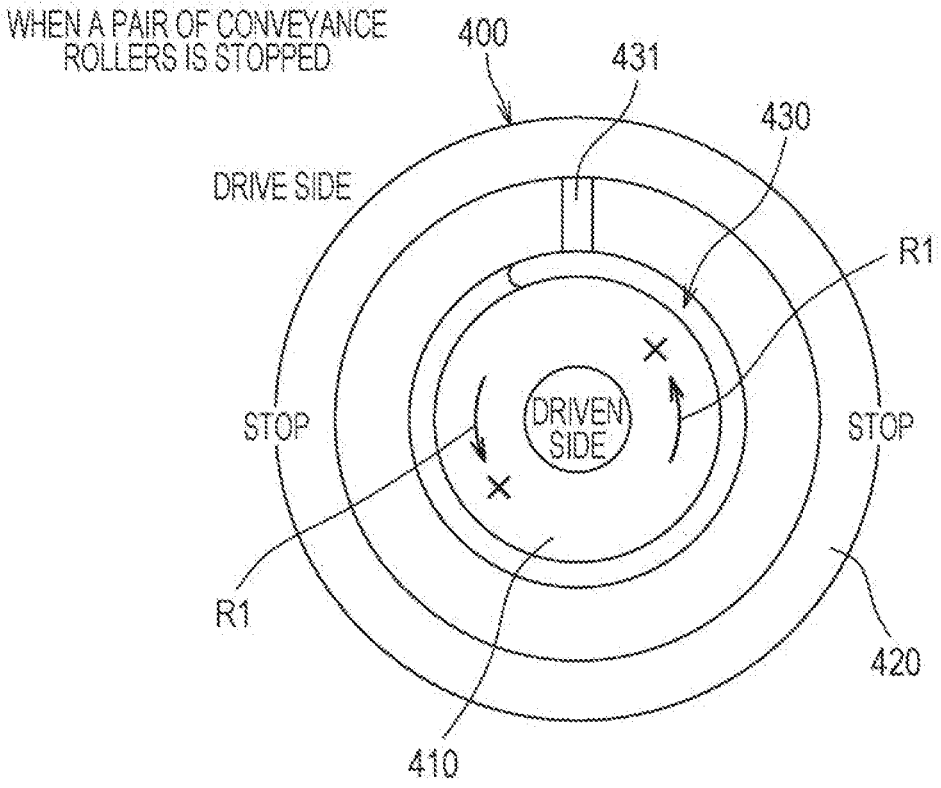
FIG. 5B is a schematic sectional view schematically illustrating an operation state of the one-way clutch illustrated in FIG. 5A when the pair of conveyance rollers is stopped.

FIG. 4B is a schematic sectional view schematically illustrating an operation state of the one-way clutch 400 illustrated in FIG. 4A when the pair of conveyance rollers 210 is stopped. FIG. 5B is a schematic sectional view schematically illustrating an operation state of the one-way clutch 400 illustrated in FIG. 5A when the pair of conveyance rollers 210 is stopped.

The outer race 420 on the drive side is connected to the rotational driving unit by which the drive roller 211 is driven. When the pair of conveyance roller 210 is stopped, the rotational driving unit does not rotate and thus the drive roller 211 does not rotate. Therefore, even when the leading edge P1 of the sheet P is brought into contact with the pair of conveyance rollers 210 while the pair of conveyance rollers 210 is stopped, the outer race 420 on the drive side does not rotate in the first rotation direction R1 that is the sheet conveyance direction S. Moreover, even in a case where the inner race 410 on the driven side tries to rotate in the first rotation direction R1 when the leading edge P1 of the sheet P is brought into contact with the pair of conveyance rollers 210, as illustrated in FIGS. 4B and 5B, the one-way clutch 400 restricts rotation of the inner race 410, which is on the driven side, in the first rotation direction R1 with respect to the stopped outer race 420 on the drive side. Thus, the inner race 410 on the driven side also does not rotate in the first rotation direction R1.

As described above, by connecting the inner race 410 to the driven side and connecting the outer race 420 to the drive side, the one-way clutch 400 is able to be provided easily and compactly in the drive transmission mechanism 300.

Second Embodiment

[When Inner Race is Connected to Drive Side and Outer Race is Connected to Driven Side]

Next, an example in which the one-way clutch 400 has the inner race 410 connected on the drive side and the outer race 420 connected on the driven side will be described below with reference to FIGS. 6A to 7B.

(When Sheet is Conveyed by a Pair of Conveyance Rollers)

Figure 6A:
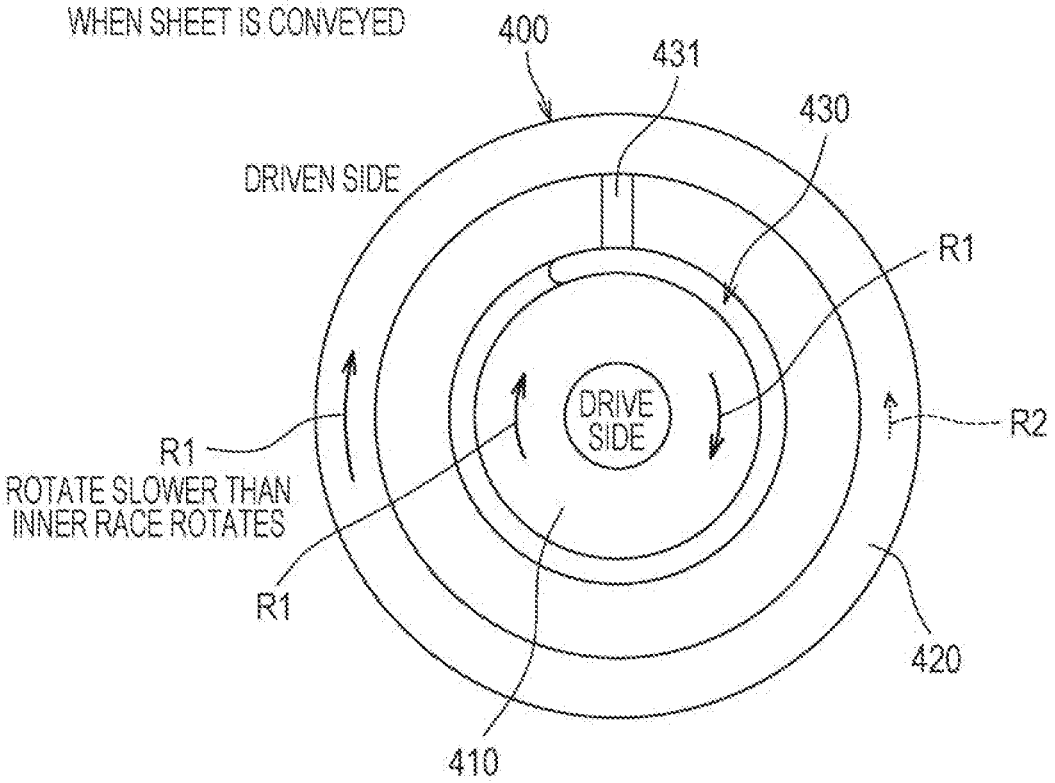
FIG. 6A is a schematic sectional view schematically illustrating an operation state of another example of the one-way clutch in a case where a sheet is conveyed by the pair of conveyance rollers when the first rotation direction is clockwise.
Figure 7A:
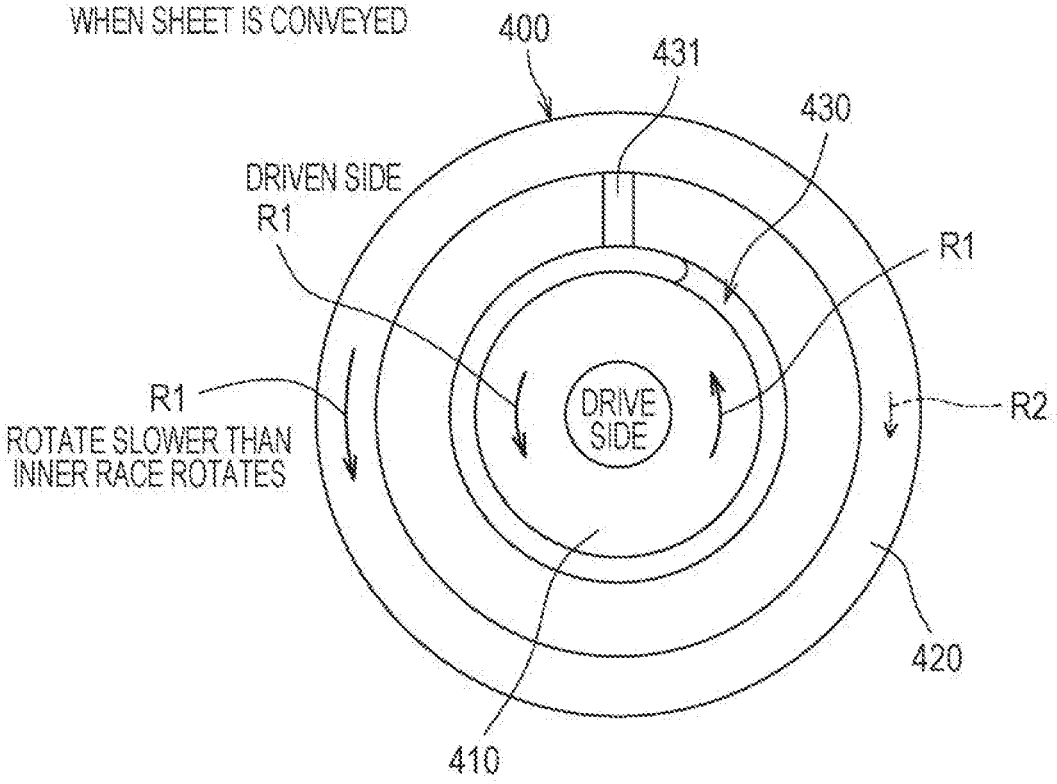
FIG. 7A is a schematic sectional view schematically illustrating an operation state of another example of the one-way clutch in a case where a sheet is conveyed by the pair of conveyance rollers when the first rotation direction is counterclockwise.

FIG. 6A is a schematic sectional view schematically illustrating an operation state of another example of the one-way clutch 400 in a case where a sheet is conveyed by the pair of conveyance rollers 210 when the first rotation direction R1 is clockwise. FIG. 7A is a schematic sectional view schematically illustrating an operation state of another example of the one-way clutch 400 in a case where a sheet is conveyed by the pair of conveyance rollers 210 when the first rotation direction R1 is counterclockwise.

The drive transmission mechanism 300 is configured so that the surface moving speed V2 of the driven roller 212 is higher than the surface moving speed V1 of the drive roller 211, but as illustrated in FIGS. 6A and 7A, since the inner race 410 rotates slower than the outer race 420 rotates, the one-way clutch 400 is brought into an idling state. Then, the driven roller 212 is driven to rotate in the first rotation direction R1 when the surface of the roller unit 212*a* contacts the surface of the roller unit 211*a* of the drive roller 211 which is rotationally driven in the first rotation direction R1. Accordingly, a rotational driving force is transmitted from the drive roller 211 to the driven roller 212 not via the drive transmission mechanism 300 but via the roller units 211*a* and 212*a*. That is, the surface moving speed V2 of the driven roller 212 becomes higher than the surface moving speed V1 of the drive roller 211 by the drive transmission mechanism 300, but idling of the one-way clutch 400 makes the surface moving speed V1 of the drive roller 211 and the surface moving speed V2 of the driven roller 212 the same or substantially the same. At this time, in the one-way clutch 400, both the inner race 410 and the outer race 420 rotate in the same first rotation direction R1. However, since the surface moving speed of the drive roller 211 and the surface moving speed of the driven roller 212 become the same or substantially the same, the outer race 420 on the driven side relatively rotates in the second rotation direction R2 accordingly with respect to the inner race 410 on the drive side. That is, a rotation speed of the outer race 420 in the first rotation direction R1 becomes lower than a rotation speed of the inner race 410 in the first rotation direction R1.

(When a Pair of Conveyance Rollers is Stopped)

Figure 6B:
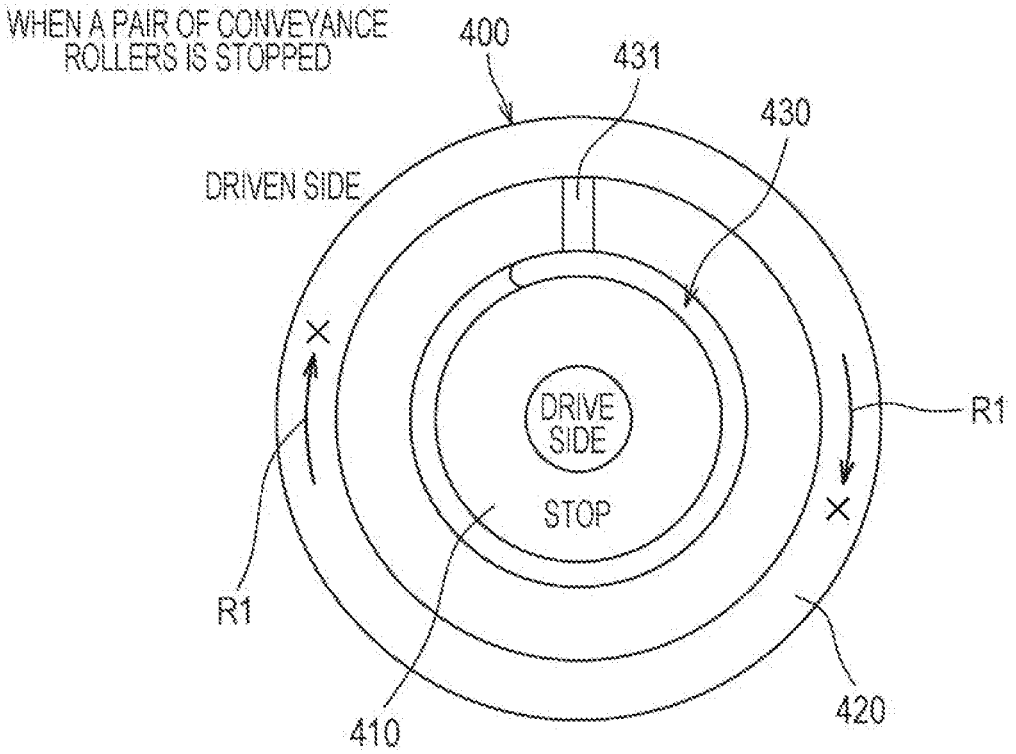
FIG. 6B is a schematic sectional view schematically illustrating an operation state of the one-way clutch illustrated in FIG. 6A when the pair of conveyance rollers is stopped.
Figure 7B:
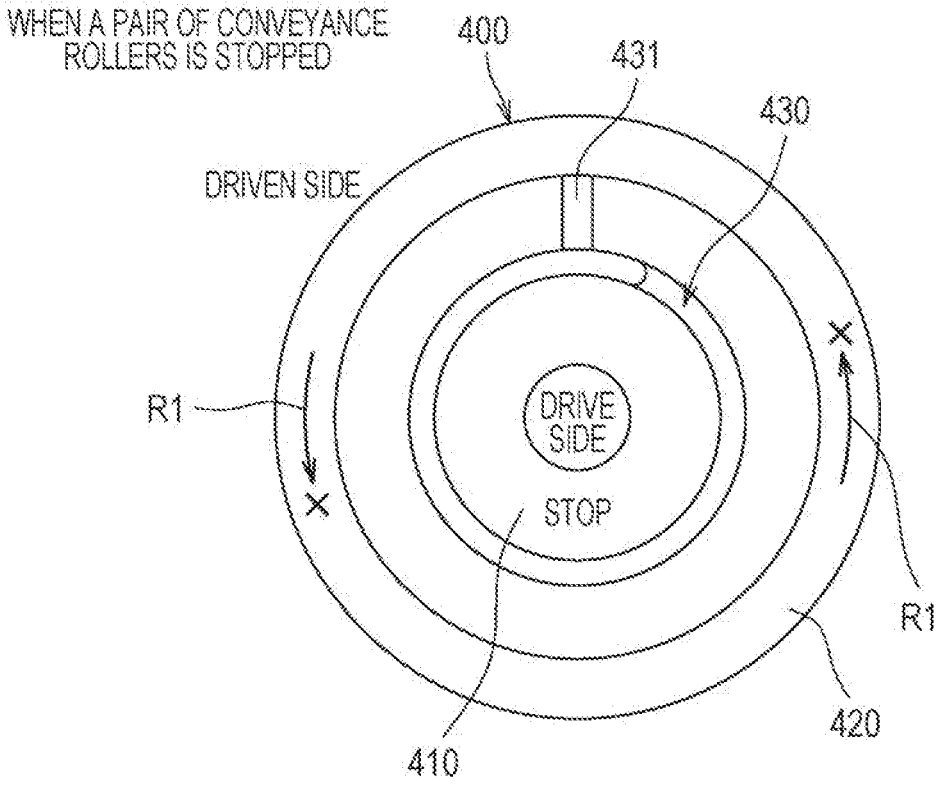
FIG. 7B is a schematic sectional view schematically illustrating an operation state of the one-way clutch illustrated in FIG. 7A when the pair of conveyance rollers is stopped.

FIG. 6B is a schematic sectional view schematically illustrating an operation state of the one-way clutch 400 illustrated in FIG. 6A when the pair of conveyance rollers 210 is stopped. FIG. 7B is a schematic sectional view schematically illustrating an operation state of the one-way clutch 400 illustrated in FIG. 7A when the pair of conveyance rollers 210 is stopped.

The inner race 410 on the drive side is connected to the rotational driving unit by which the drive roller 211 is driven. When the pair of conveyance rollers 210 is stopped, the rotational driving unit does not rotate and thus the drive roller 211 does not rotate. Therefore, even when the leading edge P1 of the sheet P is brought into contact with the pair of conveyance rollers 210 while the pair of conveyance rollers 210 is stopped, the inner race 410 on the drive side does not rotate in the first rotation direction R1 that is the sheet conveyance direction S. Moreover, even in a case where the outer race 420 on the driven side tries to rotate in the first rotation direction R1 when the leading edge P1 of the sheet P is brought into contact with the pair of conveyance rollers 210, as illustrated in FIGS. 6B and 7B, the one-way clutch 400 restricts rotation of the outer race 420, which is on the driven side, in the first rotation direction R1 with respect to the stopped inner race 410 on the drive side. Thus, the outer race 420 on the driven side also does not rotate in the first rotation direction R1.

As described above, by connecting the inner race 410 to the drive side and connecting the outer race 420 to the driven side, the one-way clutch 400 is able to be provided easily and compactly in the drive transmission mechanism 300.

Note that, the structure of the one-way clutch 400 is not limited to the structures illustrated in FIGS. 3A to 7B and various conventionally known structures may be used.

Next, a specific aspect of the drive transmission mechanism 300 and one-way clutch 400 in the sheet conveying device 200 will be described below.

Third Embodiment

Figure 8A:
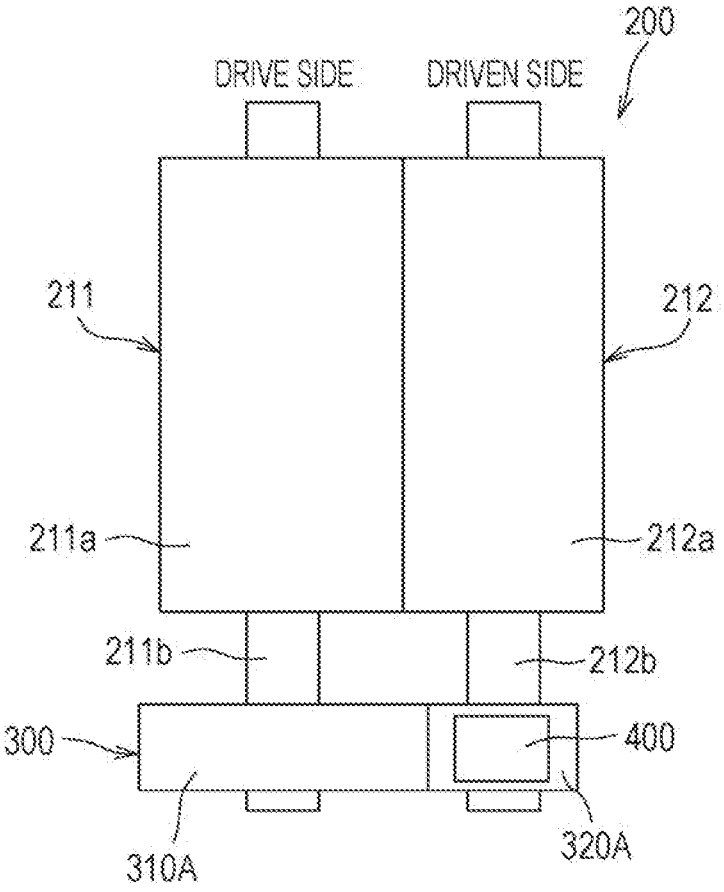
FIG. 8A is a schematic plan view illustrating an example of an arrangement configuration of the drive transmission mechanism and the one-way clutch in the sheet conveying device.
Figure 8B:
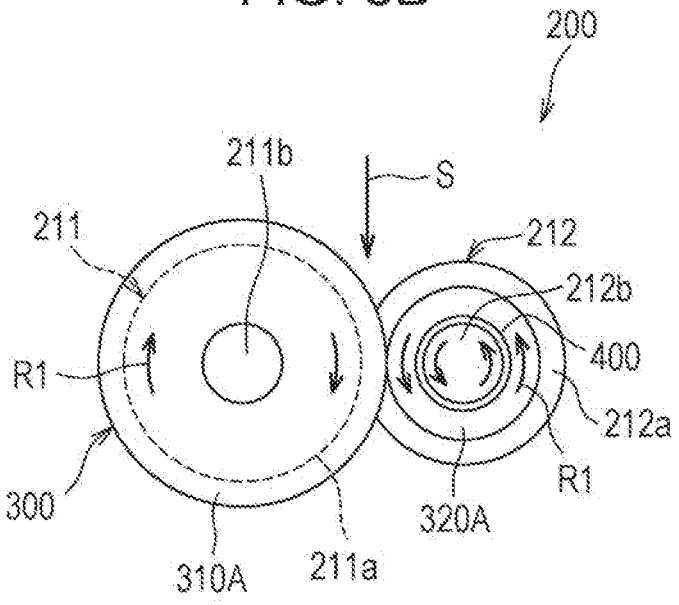
FIG. 8B is a schematic back view illustrating the example of the arrangement configuration of the drive transmission mechanism and one-way clutch in the sheet conveying device.

FIGS. 8A and 8B are respectively a schematic plan view and a schematic back view each illustrating an example of an arrangement configuration of the drive transmission mechanism 300 and the one-way clutch 400 in the sheet conveying device 200.

As illustrated in FIGS. 8A and 8B, the drive transmission mechanism 300 includes a drive gear 310A and a driven gear 320A. A drive shaft 211*b* of the drive roller 211 is provided with the drive gear 310A. A driven shaft 212*b* of the driven roller 212 is provided with the driven gear 320A. The driven gear 320A is engaged with the drive gear 310A.

Then, the one-way clutch 400 is provided between the driven shaft 212*b* and the driven gear 320A.

Note that, the one-way clutch 400 may be provided between the drive gear 310A and the drive shaft 211*b*. Thereby, the configuration in which the one-way clutch 400 is provided in the drive transmission mechanism 300 is able to be easily realized by a simple configuration in which the drive gear 310A and the driven gear 320A are included in the drive transmission mechanism 300.

Here, in the sheet conveying device 200, a gear ratio of the drive gear 310A and the driven gear 320A, and an outer diameter of the roller unit 211*a* of the drive roller 211 and an outer diameter of the roller unit 212*a* of the driven roller 212 are set so that the surface moving speed V2 of the driven roller 212 is higher than the surface moving speed V1 of the drive roller 211.

Fourth Embodiment

Figure 9A:
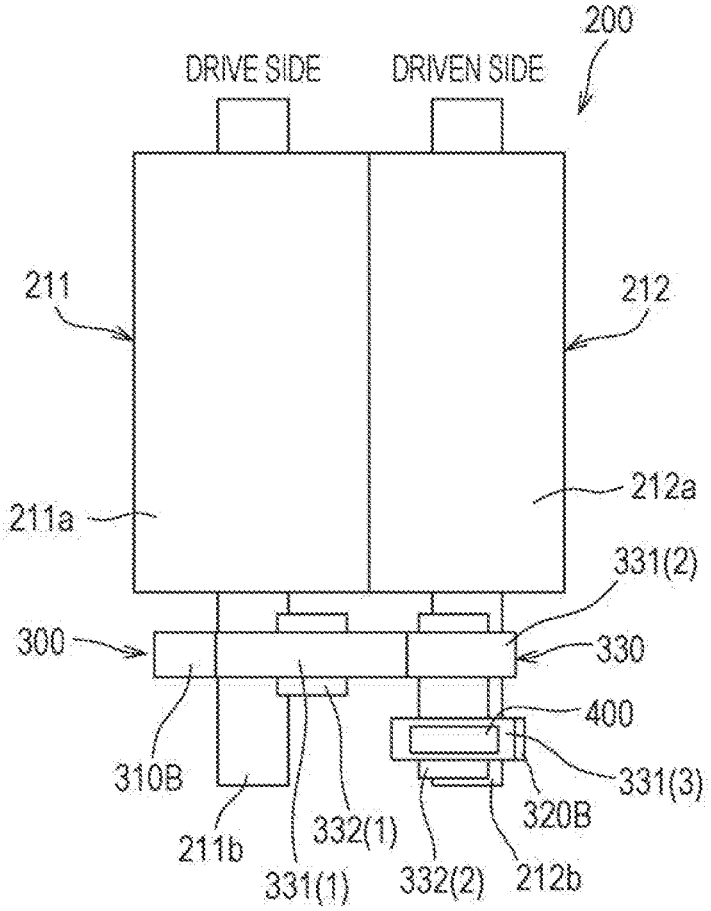
FIG. 9A is a schematic plan view illustrating another example of the arrangement configuration of the drive transmission mechanism and the one-way clutch in the sheet conveying device.
Figure 9B:
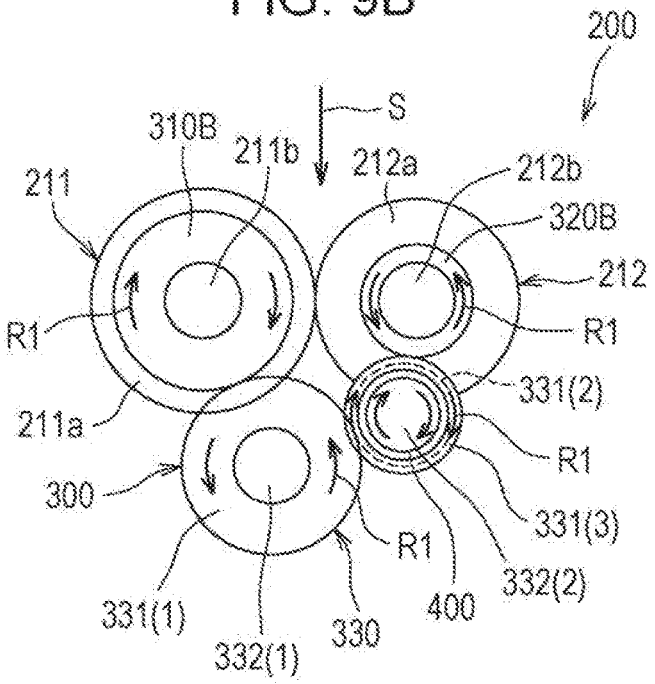
FIG. 9B is a schematic back view illustrating another example of the arrangement configuration of the drive transmission mechanism and the one-way clutch in the sheet conveying device.

FIGS. 9A and 9B are respectively a schematic plan view and a schematic back view each illustrating another example of the arrangement configuration of the drive transmission mechanism 300 and the one-way clutch 400 in the sheet conveying device 200.

As illustrated in FIGS. 9A and 9B, the drive transmission mechanism 300 includes a drive gear 310B, a driven gear 320B, and a gear train 330. The drive shaft 211*b* of the drive roller 211 is provided with the drive gear 310B. The driven shaft 212*b* of the driven roller 212 is provided with the driven gear 320B. The gear train 330 is engaged with both the drive gear 310B and the driven gear 320B.

The gear train 330 is composed of a plurality of intermediate gears 331(1) to 331(*n*) (n is an integral number of 2 or more, n=3 in this example). A plurality of intermediate gear shafts 332(1) to 332(*m*) (m is an integral number of 2 or more, m=2 in this example) are respectively provided in the plurality of intermediate gears 331(1) to 331(*n*). The plurality of intermediate gears 331(1) to 331(*n*) are engaged with each other.

Then, the one-way clutch 400 is provided at any one place between the intermediate gears 331(1) to 331(*n*) and the intermediate gear shafts 332(1) to 332(*m*).

In this example, the one-way clutch 400 is provided between the intermediate gear 331(3) and the intermediate gear shaft 332(2). Specifically, the intermediate gear shaft 332(1) is provided with the intermediate gear 331(1). The intermediate gear 331(1) is engaged with the drive gear 310B. The intermediate gear shaft 332(2) is provided with the intermediate gear 331(2). The intermediate gear 331(2) is engaged with the intermediate gear 331(1). The intermediate gear shaft 332(2) is provided with the intermediate gear 331(3). The intermediate gear 331(3) is engaged with the driven gear 320B.

Note that, the one-way clutch 400 may be provided between another intermediate gear 331 and another intermediate gear shaft 332, between the drive gear 310B and the drive gear shaft 211*b*, or between the driven gear 320B and the driven gear shaft 212*b*. Thereby, the configuration in which the one-way clutch 400 is provided in the drive transmission mechanism 300 is able to be easily realized by a simple configuration in which the drive gear 310B, the driven gear 320B, and the gear train 330 are included in the drive transmission path.

Here, in the sheet conveying device 200, gear ratios of the drive gear 310B, the driven gear 320B, the gear train 330, and the outer diameter of the roller unit 211*a* of the drive roller 211 and the outer diameter of the roller unit 212*a* of the driven roller 212 are set so that the surface moving speed V2 of the driven roller 212 is higher than the surface moving speed V1 of the drive roller 211.

OTHER EMBODIMENTS

In the examples described above, the drive transmission mechanism is configured by only gears, but may include a gear and a belt, a pulley and a belt, or the like.

The disclosure is not limited to each of the embodiments described above and may be implemented in other various forms. Accordingly, the embodiments are merely examples in all respects and are not to be interpreted as being limiting. The scope of the disclosure is indicated by the scope of the Claims and is not restricted in any way to the specification itself. Furthermore, all modifications and changes falling within a range equivalent to the scope of the Claims are encompassed in the scope of the disclosure.

The present disclosure contains subject matter related to that disclosed in Japanese Priority Patent Application JP 2018-106040 filed in the Japan Patent Office on Jun. 1, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A sheet conveying device that conveys a sheet in a predetermined sheet conveyance direction by a pair of conveyance rollers comprising a drive roller and a driven roller, the sheet conveying device comprising:

a drive transmission mechanism that is configured by a gear or a pulley so that, when a rotational driving force from the drive roller is transmitted to the driven roller, a surface moving speed of the driven roller is higher than a surface moving speed of the drive roller; and a one-way clutch that is provided at any place in a drive transmission path from the drive roller to the driven roller in the drive transmission mechanism, wherein the one-way clutch restricts relative rotation of the driven roller in a first rotation direction, which is the sheet conveyance direction, with respect to the drive roller while allowing relative rotation of the driven roller in a second rotation direction, which is a direction opposite to the first rotation direction, with respect to the drive roller, and the rotational driving force from the drive roller is transmitted to the driven roller via the drive transmission mechanism, and via a surface of the drive roller and a surface of the driven roller that are brought into contact with each other.

2. The sheet conveying device according to claim 1, wherein the drive transmission mechanism includes a drive gear provided in a drive shaft of the drive roller and a driven gear that is provided in a driven gear shaft of the driven roller and engaged with the drive gear, and the one-way clutch is provided between the drive gear and the drive shaft or between the driven shaft and the driven gear.

3. The sheet conveying device according to claim 1, wherein the drive transmission mechanism includes a drive gear provided in a drive shaft of the drive roller, a driven gear provided in a driven gear shaft of the driven roller, and a gear train that is engaged with both the drive gear and the driven gear, the gear train comprising a plurality of intermediate gears that are provided in a plurality of intermediate gear shafts and engaged with each other, and the one-way clutch is provided at any one place between the drive gear and the drive shaft, between the driven gear and the driven shaft, or between the intermediate gears and the intermediate gear shafts.

4. The sheet conveying device according to claim 1, wherein the one-way clutch includes a first member and a second member that are provided in such a manner that relative rotation of the first member with respect to the second member is freely allowed in one direction and is not allowed in the other direction, and the first member is connected to a driven side and the second member is connected to a drive side, or the first member is connected to the drive side and the second member is connected to the driven side.

5. An image forming apparatus comprising the sheet conveying device according to claim 1, wherein in a state where rotation of the pair of conveyance rollers is stopped, after a leading edge of the conveyed sheet is brought into contact with the pair of conveyance rollers to temporarily stop the sheet, the pair of conveyance rollers rotates to convey the sheet.

6. A sheet conveying method that conveys a sheet in a predetermined sheet conveyance direction by a pair of conveyance rollers comprising a drive roller and a driven roller, the sheet conveying method comprising:

arranging a drive transmission path from the drive roller to the driven roller to make a surface moving speed of the driven roller higher than a surface moving speed of the drive roller by using a gear or a pulley when a rotational driving force from the drive roller is transmitted to the driven roller; and by a one-way clutch that is provided at any place in the drive transmission path from the drive roller to the driven roller, restricting relative rotation of the driven roller in a first rotation direction, which is the sheet conveyance direction, with respect to the drive roller while allowing relative rotation of the driven roller in a second rotation direction, which is a direction opposite to the first rotation direction, with respect to the drive roller.

* * * * *